US010428489B2

(12) United States Patent
Kojima et al.

(10) Patent No.: US 10,428,489 B2
(45) Date of Patent: Oct. 1, 2019

(54) ARM FOR CONSTRUCTION MACHINE

(71) Applicant: KOBELCO CONSTRUCTION MACHINERY CO., LTD., Hiroshima-shi (JP)

(72) Inventors: Yuki Kojima, Hiroshima (JP); Takashi Mizomoto, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 332 days.

(21) Appl. No.: 15/520,225

(22) PCT Filed: Oct. 21, 2015

(86) PCT No.: PCT/JP2015/079672
§ 371 (c)(1),
(2) Date: Apr. 19, 2017

(87) PCT Pub. No.: WO2016/072261
PCT Pub. Date: May 12, 2016

(65) Prior Publication Data

US 2017/0314226 A1 Nov. 2, 2017

(30) Foreign Application Priority Data

Nov. 6, 2014 (JP) ..... 2014-225978

(51) Int. Cl.
*E02F 3/38* (2006.01)
*E02F 9/00* (2006.01)
*E02F 9/14* (2006.01)

(52) U.S. Cl.
CPC ..... *E02F 3/38* (2013.01); *E02F 9/006* (2013.01); *E02F 9/14* (2013.01)

(58) Field of Classification Search
CPC ... B23K 9/02; B23K 33/00; E02F 3/38; E02F 3/382; E02F 3/384; E02F 9/14; Y10S 414/131
(Continued)

(56) References Cited

U.S. PATENT DOCUMENTS 3,902,295 A * 9/1975 Yancey ..... E02F 3/38 37/379
4,034,876 A * 7/1977 Yancey ..... E02F 3/32 29/897

(Continued)

FOREIGN PATENT DOCUMENTS

CN 1429953 A 7/2003
CN 201924385 U 8/2011

(Continued)

OTHER PUBLICATIONS

Extended European Search Report dated Nov. 29, 2017 in Patent Application No. 15857369.1, citing documents AA and AO therein, 7 pages.

(Continued)

*Primary Examiner* — Saul Rodriguez
*Assistant Examiner* — Brendan P Tighe
(74) *Attorney, Agent, or Firm* — Oblon, McClelland, Maier & Neustadt, L.L.P.

(57) ABSTRACT

An arm for a construction machine, including an arm top formed by casting, being easily produced with high dimensional accuracy. The arm includes an arm body and an arm top. The arm top is formed of left and right arm top pieces individually formed by casting and joined together. The left and right arm top pieces include first left and right bosses constituting a first connection section, second left and right bosses constituting a second connection portion, and left and right projecting wall portions constituting a connection wall (Continued)

connecting the first and second connection portions to each other, respectively. The left and right arm top pieces are joined together by welding at respective opposing surfaces of the first left and right bosses, those of the second left and right bosses and those of the left and right projecting wall portions, thereby forming the arm top.

9 Claims, 16 Drawing Sheets

(58) Field of Classification Search
USPC ..... 414/543, 680, 686, 691, 694, 727
See application file for complete search history.

(56) References Cited

U.S. PATENT DOCUMENTS

| | | | | |
|---|---|---|---|---|
| 7,354,238 | B2 * | 4/2008 | Fukudome ..... | E02F 3/34 172/274 |
| 2002/0174573 | A1 | 11/2002 | Ichikawa et al. | |
| 2003/0118433 | A1 * | 6/2003 | Janes ..... | B23K 31/12 414/722 |
| 2014/0010624 | A1 | 1/2014 | Sugaya et al. | |

FOREIGN PATENT DOCUMENTS

| | | | |
|---|---|---|---|
| CN | 10-2012-0063889 | A | 6/2012 |
| CN | 202280092 | U | 6/2012 |
| CN | 203145069 | U | 8/2013 |
| JP | 6-53653 | U | 7/1994 |
| JP | 6-220880 | A | 8/1994 |
| JP | 2002-332654 | A | 11/2002 |
| JP | 2005-163375 | A | 6/2005 |
| JP | 2008-240343 | A | 10/2008 |
| JP | 2012-21336 | A | 2/2012 |
| JP | 2012-241423 | A | 12/2012 |

OTHER PUBLICATIONS

International Search Report dated Dec. 8, 2015 in PCT/JP2015/079672 filed Oct. 21, 2015.

* cited by examiner

ARM FOR CONSTRUCTION MACHINE

TECHNICAL FIELD

The present invention relates to an arm to constitute a working attachment for a construction machine such as excavator, the arm including an arm top serving as a distal-end member and formed by casting.

BACKGROUND ART

Conventionally, there are known arms for a construction machine, the arm including an arm top formed by casting, as shown in Patent Literatures 1 and 2. The arm top does not include any weld involving high stress concentration, which allows the arm top to have a high strength.

However, the techniques disclosed in Patent Literatures 1 and 2, involving integrally forming the entire arm top by casting, requires a large and complicated mold for the casting which is hard to produce and it is difficult to obtain high production accuracy.

CITATION LIST

Patent Literature

Patent Literature 1: Japanese Unexamined Patent Publication No. 2005-163375

Patent Literature 2: Japanese Unexamined Patent Publication No. 2008-240343

SUMMARY OF INVENTION

The object of the present invention aims to provide an arm for a construction machine, the arm being formed by casting and capable of being easily produced with high accuracy.

Provided is an arm to constitute a working attachment for a construction machine, the arm including: an arm body to be attached to a distal end of a boom constituting the working attachment; and an arm top attached to a distal end of the arm body.

The arm top includes: a pair of left and right side walls; a first connection portion disposed at a distal end of the arm top to span the pair of side walls so as to define a first pin hole for allowing a pin for connecting a working tool to the distal end of the arm top to be inserted into the first pin hole; a second connection portion disposed at a position closer to a proximal end of the arm top than the first connection portion to span the pair of side walls so as to define a second pin hole for allowing a pin for connecting a link for actuating the working tool to be inserted in the second pin hole; and connection walls formed on respective inner surfaces of the side walls, the connection walls having respective shapes to connect the pair of side walls to each other and connect the first and second connection portions to each other.

The arm top includes a left arm top piece and a right arm top piece that are individually formed by casting, the left arm top piece having a first left boss constituting the first connection portion, a second left boss constituting the second connection portion, and a left projecting wall portion constituting the connection wall, the right top piece having a first right boss constituting the first connection portion, a second right boss constituting the second connection portion, and a right projecting wall portion constituting the connection wall. The first left boss and the first right boss have respective surfaces opposed to each other in a left-right direction of the arm top, the second left boss and the second right boss have respective surfaces opposed to each other in the left-right direction of the arm top, and the left projecting wall portion and the right projecting wall portion have respective surfaces opposed to each other in the left-right direction.

The left and right arm top pieces are joined together by welding at the opposed surfaces of the first left boss and the first right boss, at the opposed surfaces of the second left boss and the second right boss, and at the opposed surfaces of the left projecting wall portion and the right projecting wall portion, thereby being integrated to form the arm top.

DESCRIPTION OF EMBODIMENTS

There will be described a reference example with reference to FIGS. 12 to 16 in advance of describing embodiments of the present invention, the reference example being provided for explanation of the characteristics of an arm according to the embodiments.

Figure 12:
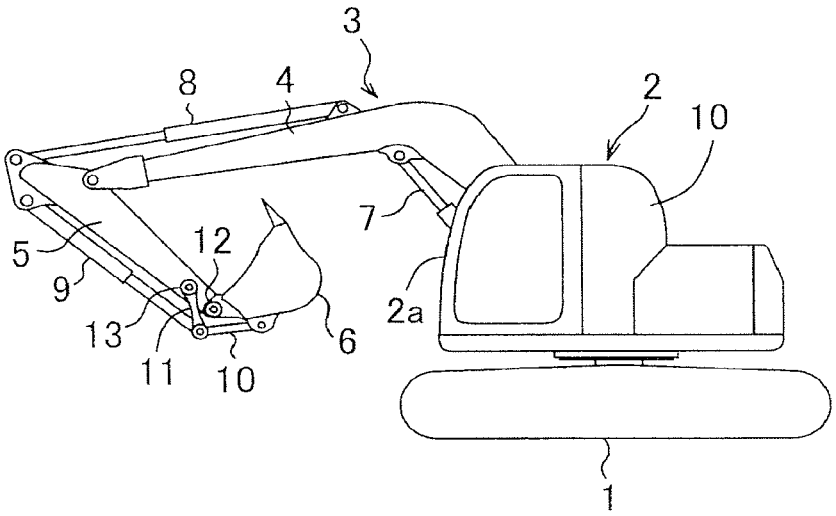
FIG. 12 is a schematic side view of an excavator including an arm according to a reference example.

FIG. 12 shows an excavator including an arm 5 according to the reference example. The excavator includes a crawler-type lower travelling body 1, an upper slewing body 2 mounted on the lower travelling body 1 so as to be slewable about an axis normal to the ground, the upper slewing body 2 including a cabin 2*a*, and a working attachment 3 attached to the upper slewing body 2.

The working attachment 3 includes a boom 4, the arm 5, a working tool, a plurality of hydraulic cylinders, a main link 10, and an idler link 11. The boom 4 is attached to the upper slewing body 2 in a raisable and lowerable manner, and the arm 5 is attached to a distal end of the boom 4. The working tool, namely, a bucket 6 in this reference example, is attached to a distal end of the arm 5. The plurality of hydraulic cylinders include a boom cylinder 7, an arm cylinder 8, and a bucket cylinder 9 that expand and contract to move the boom 4, the arm 5, and the bucket 6, respectively.

The main link 10 and the idler link 11 are disposed in such a way as to transmit an expansion/contraction force of the bucket cylinder 9 to the bucket 6 to rotationally move the bucket. Specifically, the main link 10 includes a first end to be connected to a distal end of the bucket cylinder 9 through a pin, and a second end to be connected to the bucket 6 through a pin. Similarly, the idler link 11 includes a first end to be connected to the distal end of the bucket cylinder 9 through a pin, and a second end connected to the arm 5 through a pin.

The arm 5 includes a first connection portion 12 and a second connection portion 13. The first connection portion 12 is disposed at a distal end of the arm 5, and the bucket 6 is connected to the first connection portion 12 through a pin. The second connection portion 13 is disposed at a position closer to a proximal end (i.e., an end to be connected to the boom 4) of the arm 5 than the first connection portion 12, the idler link 11 being connected to the second connection portion 13 through a pin.

Next will be described the structure of the arm 5 including the first and second connection portions 12 and 13, with reference to FIGS. 13 to 16. In the description hereinafter, the terms "right" and "left" indicate the respective directions seen from an operator in the cabin 2*a*, and the term "left-right direction" corresponds to a width direction of the arm 5.

The arm 5 includes an arm body 14 and an arm top 15. The arm body 14 serves as an arm-proximal-end member, including a plurality of plates forming a box structure, namely, a pair of left and right side plates 14*a*, a top plate 14*b* and a bottom plate 14*c*. The arm top 15 serves as a distal-end member to be attached to the distal end of the arm body 14.

Each of the top plate 14*b* and the bottom plate 14*c* of the arm body 14 has a length equivalent to the full length of the arm 5. Each of the left and right side plates 14*a* is shorter than the top plate 14*b* and the bottom plate 14*c*. The arm top 15 is joined to the distal end of the arm body 14 by welding in such a way as to make up the dimensional difference of the left and right side plates 14*a* from the top and bottom plates 14*b*, 14*c*, thereby integrated with the arm body 14.

Figure 15:
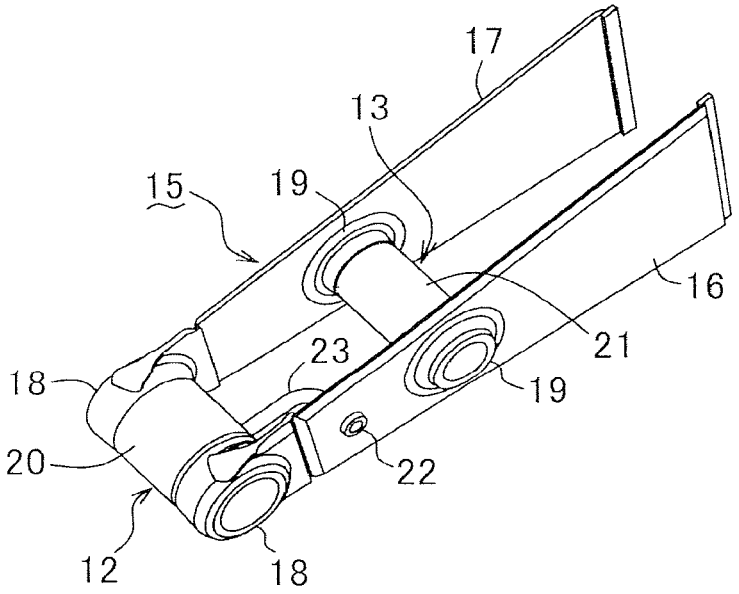
FIG. 15 is a perspective view of the arm according to the reference example.
Figure 16:
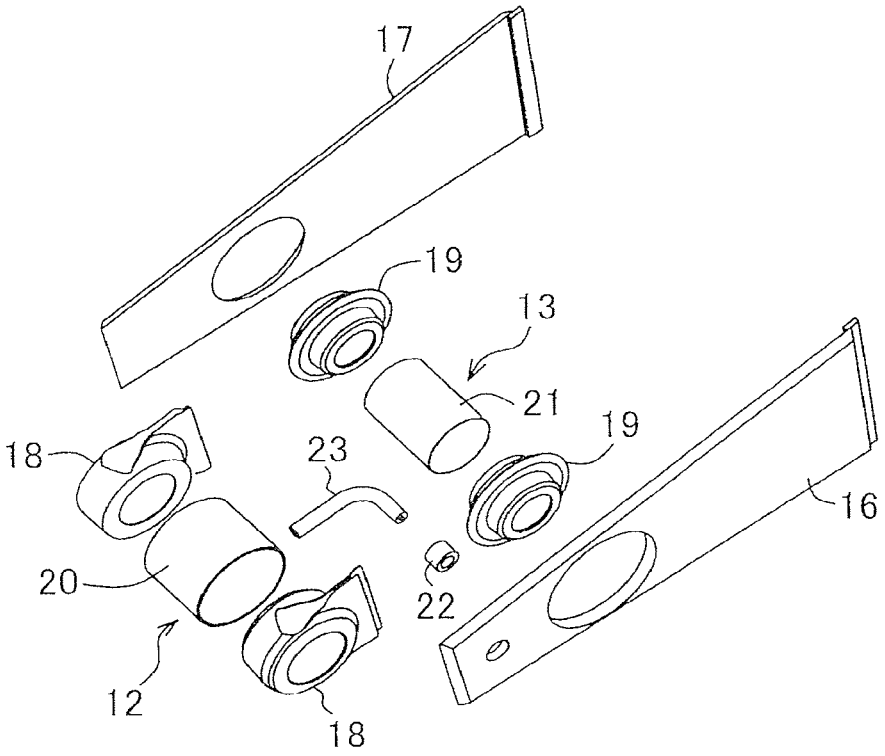
FIG. 16 is an exploded perspective view of the arm according to the reference example.

The arm top 15 includes left and right side walls 16, 17 as shown in the enlarged views of FIGS. 15 and 16. The first connection portion 12 and the second connection portion 13 to which the bucket 16 and the idler link 11 are connected, as mentioned above, respectively, are disposed at a distal end of the arm top 15 and at a position closer to the proximal end of the arm top 15 than the distal end, respectively, so as to span the side walls 16 and 17.

The first and second connection portions 12, 13 are formed by assembling a plurality of components such as those shown in FIG. 16. The plurality of components include: a pair of ring members 18, 18 and a pair of ring members 19, 19 that are welded to the side walls 16, 17; a tube member 20 disposed so as to span the ring members 18, 18; and a tube member 21 disposed so as to span the ring members 19, 19. The plurality of components are assembled to form the first and second connection portions 12, 13 as respective bosses each enclosing an enclosed pin hole.

The arm top 15 further includes an oil supply inlet 22 and an oil supply pipe 23 shown in FIG. 16. The oil supply inlet 22 is attached to one of the side walls 16, 17, for example, the left side wall 16. The oil supply pipe 23 is disposed in such a way as to bring the oil supply inlet 22 into communication with the pin hole enclosed by the tube member 19 of the first connection portion 12.

In the arm top 15 according to the reference example, stress concentration is likely to occur in respective welds between the side walls 16, 17 and the ring members 18, 19 of the first and second connection portions 12, 13. The stress concentration hinders the arm top 15 from having a high strength.

Respective arms according to embodiments of the present invention solve the above-mentioned problem found in the arm 5 of the reference example. The arms according to the embodiments will be described hereinafter with reference to FIGS. 1 to 11.

The arms according to first to third embodiments shown below share the following common configuration with the arm of the reference example. Specifically, each of the arms according to the first to third embodiments includes an arm body 14 and an arm top 25. The arm body 14 includes a box structure capable of being attached to a distal end of a boom similar to the boom 4 of the working attachment 3 shown in FIG. 12. The arm top 25 is serves as a distal-end member to be attached to the distal end of the arm body 14.

Next will be described respective characteristic features of the arms according to the first to third embodiments, i.e., respective differences of the arm tops 25 according to the first to third embodiments from the arm top 15 of the reference example.

Figure 1:
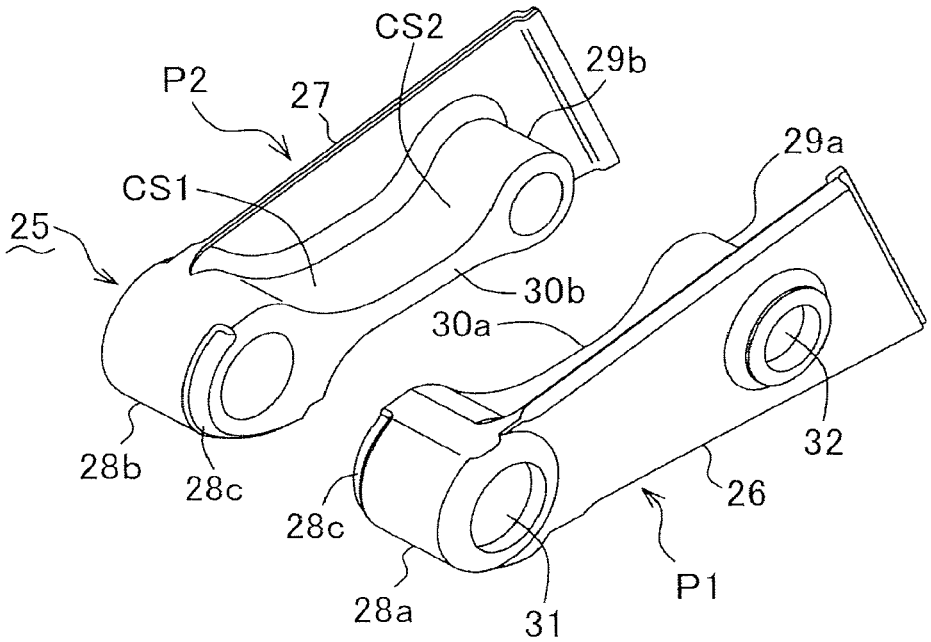
FIG. 1 is a perspective view of a pair of arm top pieces before being assembled, the arm top pieces constituting an arm top according to a first embodiment of the present invention.
Figure 2:
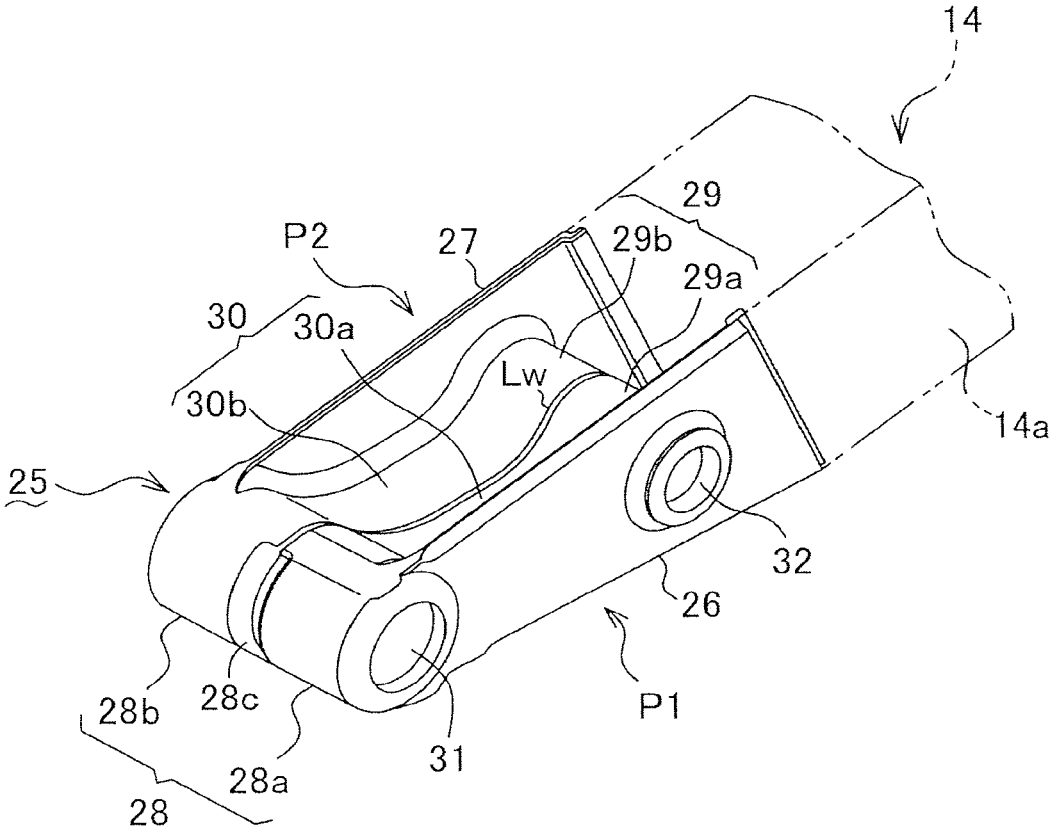
FIG. 2 is a top perspective view of the arm top formed by joining the pair of arm top pieces together.
Figure 3:
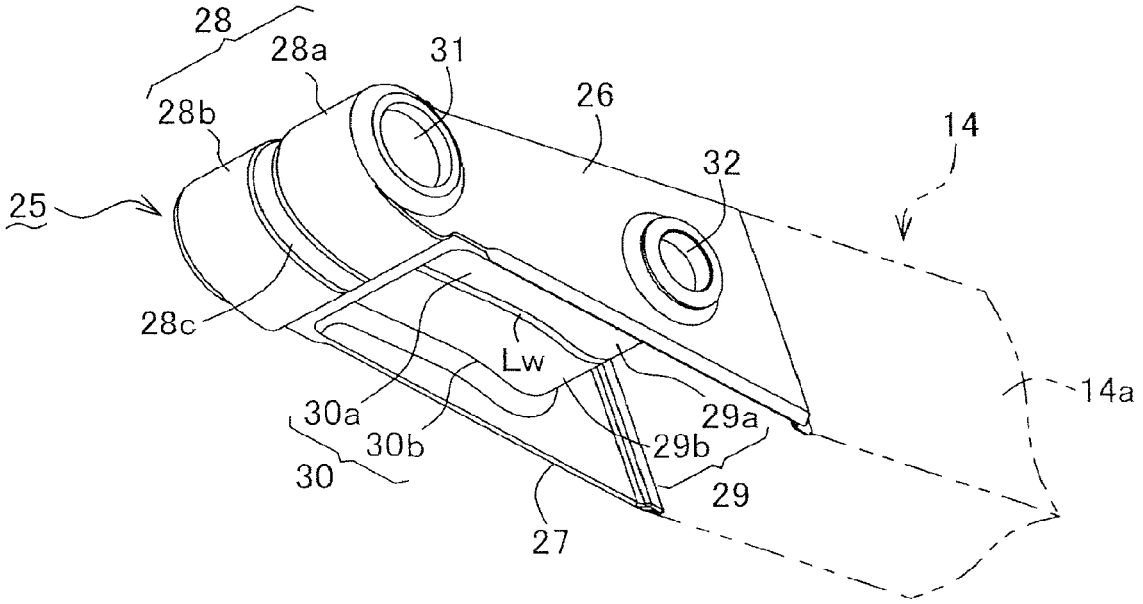
FIG. 3 is a bottom perspective view of the arm top.

FIGS. 1 to 7 show the arm top 25 according to the first embodiment. The arm top 25 includes a pair of left and right side walls 26, 27, a first connection portion 28, a second connection portion 29, and a connection wall 30. The side walls 26, 27 are joined to respective distal ends of a pair of left and right side plates 14*a* of the arm body 14, as shown in FIGS. 2 and 3. The first connection portion 28 is disposed so as to span the side walls 26, 27 in order to connect a working tool such as the bucket 6 to the distal end of the arm top 25 through a pin. The second connection portion 29 is disposed so as to span the side walls 26, 27 in order to connect an idler link for actuating the working tool to a part of the arm top 25, the part being closer to the proximal end of the arm top 25 than the first connection portion 28 through a pin. The connection wall 30 is disposed so as to connect respective inner surfaces of the left and right side walls 26, 27 to each other and so as to connect the first and second connection portions 28, 29 to each other. The first and second connection portions 28, 29 have respective shapes enclosing first pin hole 31 and an enclosed second pin hole 32. The first pin hole 31 allows a pin for connecting a working tool such as the bucket 6 to the distal end of the arm top 25 to be inserted thereinto, and the second pin hole 32 allows a pin for connecting the idler link 11 to a part of the arm top 25, the part being closer to the proximal end of the arm top 25 than the distal end of the arm top 25.

The arm top 25 is constituted by a left arm top piece P1 and a right arm top piece P2. The arm top pieces P1 and P2 are individually formed by casting. Specifically, the first connection portion 28 is divided into first left boss 28*a* and first right boss 28*b*, the second connection portion 29 is divided into second left boss 29*a* and second right boss 29*b*, and the connection wall 30 is divided into left projecting wall portion 30*a* and right projecting wall portion 30*b*; the left arm top piece P1 includes the first left boss 28*a*, the second left boss 29*a* and the left projecting wall portion 30*a*, while the right arm top piece P2 includes the first right boss 28*b*, the second right boss 29*b* and the right projecting wall portion 30*b*.

The left and right arm top pieces P1 and P2 have respective opposed surfaces which are opposed to each other. Specifically, the first left boss 28*a* and the first right boss 28*b* have respective first opposed surfaces opposed to each other in a left-right direction of the arm top 25, the second left boss 29*a* and the second right boss 29*b* have respective second opposed surfaces opposed to each other in the left-right direction of the arm top 25, and the left projecting wall portion 30*a* and the right projecting wall portion 30*b* have respective third opposed surfaces opposed to each other in the left-right direction of the arm top 25. Mutual joining of the first opposed surfaces, mutual joining of the second opposed surfaces and mutual joining of the third opposed surfaces are performed by welding along a weld line Lw extending over the entire circumference. The left and right arm top pieces P1, P2 are thereby integrated to form the arm top 25. The mutual joinings of the opposing surfaces involve forming the first connection portion 28 by the connection between the first left boss 28*a* and the first right boss 28*b*, forming the second connection portion 29 by the connection between the second left boss 29*a* and the second right boss 29*b*, and forming the connection wall 30 by the connection between the left projecting wall portion 30*a* and the right projecting wall portion 30*b*. The weld line Lw corresponds to the portion indicated by oblique lines extending in different directions in FIG. 4.

Figure 5:
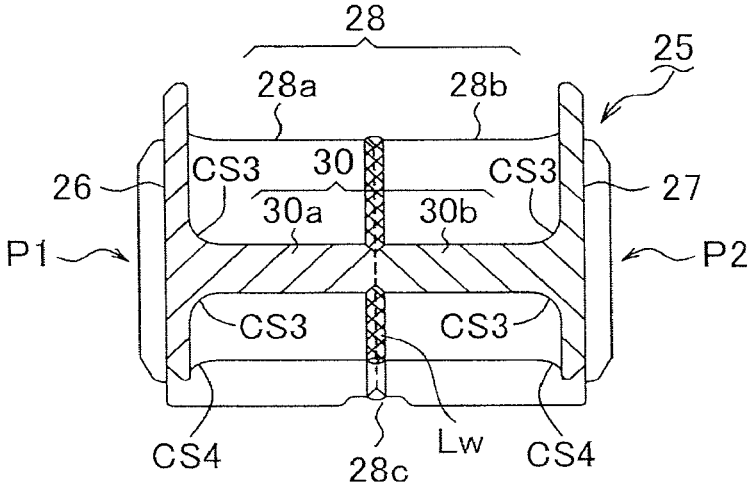
FIG. 5 is an enlarged sectional view taken along the line V-V in FIG. 4.
Figure 7:
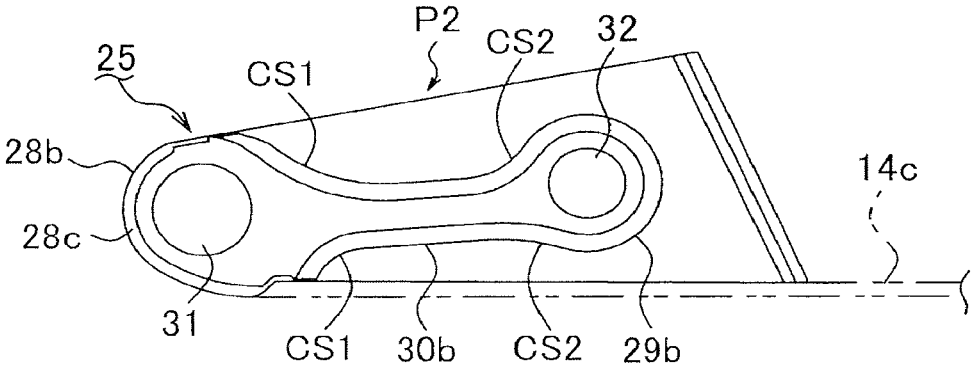
FIG. 7 is a sectional view taken along the line VII-VII in FIG. 4.

In the left and right arm top pieces P1, P2, the left and right projecting wall portions 30*a*, 30*b* are connected to the first left and right bosses 28*a*, 28*b* and to the second left and right bosses 29*a*, 29*b* via respective joining portions having gently curved surfaces CS1, CS2 as shown in FIG. 7. Similarly, the left and right projecting wall portions 30*a*, 30*b* are connected to the left and right side walls 26, 27 via joining portions each having a gently curved surface CS3 as shown in FIG. 5. The first left and right bosses 28*a*, 28*b* and the second left and right bosses 29*a*, 29*b* are connected to the left and right side walls 26, 27 via respective joining portions each having a gently curved surface CS4 as shown in FIG. 5.

Figure 4:
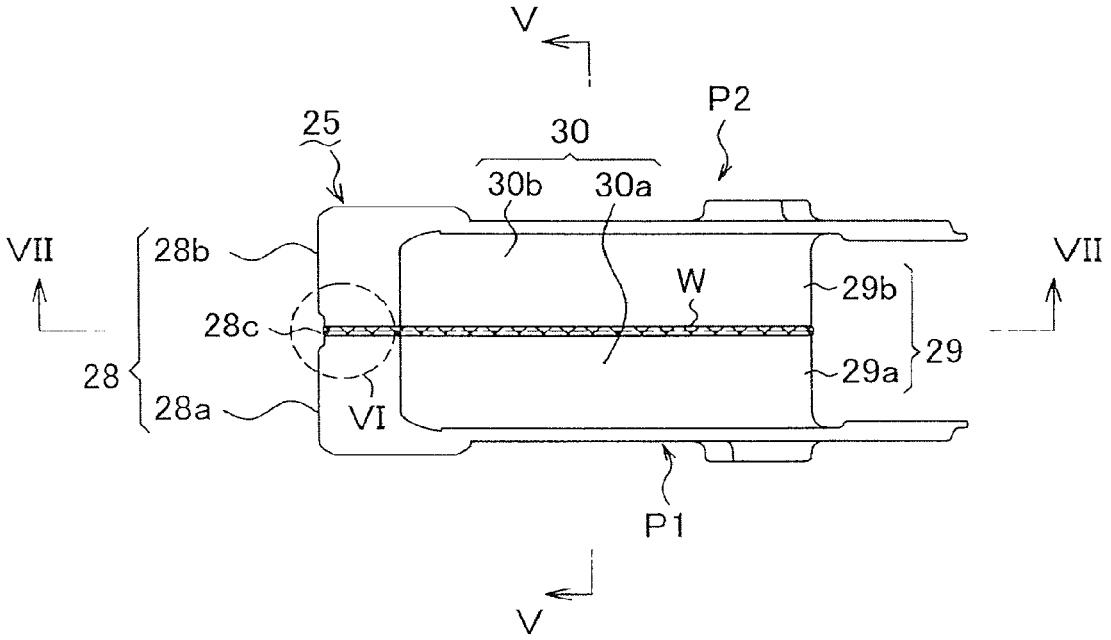
FIG. 4 is a plan view of the arm top.
Figure 6:
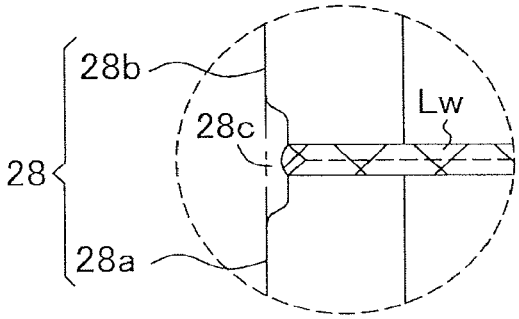
FIG. 6 is an enlarged view of a portion encompassed by the circle VI in FIG. 4.

As shown in FIGS. 4 and 6, the first left and right bosses 28*a*, 28*b* shares a recess 28*c* formed therein. The recesses 28*c* are formed in respective forward half peripheries of joint portions of the first left and right bosses 28*a*, 28*b* that are joined together by welding, the half peripheries being disposed on the distal end side of the arm top pieces P1, P2. The half peripheries are recessed radially inward so as to have a diameter smaller than that of the other parts of the first left and right bosses 28*a*, 28*b* having a maximum diameter (the parts on laterally both sides of the recesses 28*c*). The left and right arm top pieces P1, P2 are welded together at the recesses 28*c*.

The arm, thus, can be produced by a method including a step of individually forming the left and right arm top pieces P1, P2 by casting, a step of joining the left and right arm top pieces P1, P2 together by welding at the first opposed surfaces of the first left boss 28*a* and the first right boss 28*b*, at the second opposed surfaces of the second left boss 29*a* and the second right boss 29*b*, and at the third opposed surfaces of the left projecting wall portion 30*a* and the right projecting wall portion 30*b* to thereby integrate the left arm top piece P1 and the right arm top piece P2 to form the arm top 25, and a step of attaching the arm top 25 to the distal end of the arm body 14.

According to the above-described arm, the arm top 25 is originally divided into the separate left and right arm top pieces P1, P2 that are individually formed and then joined to each other by casting to be integrated, in other words, the left and right arm top pieces P1, P2 are individually formed as separate casted products; this allows a mold for the casting and the casted products to have a small and simple shape. This makes it possible to easily produce the arm top 25 with an improved dimensional accuracy, as compared to an arm top which is entirely formed of a single casted product.

Besides, the left and right arm top pieces P1, P2, which are integrated by welding over the entire circumference not at the joints between the first and second connection portions 28, 29 and the side walls 26, 27 where stress concentration is likely to occur but at the widthwise middle of the arm top 25 with low stress, can have a high strength.

Furthermore, the left and arm top pieces P1, P2 include the left and right projecting wall portions 30*a*, 30*b* disposed on respective inner surfaces of the left and right side walls 26, 27, the left and right projecting wall portions 30*a*, 30*b* connecting the left and right side walls 26, 27 to each other and connecting the first and second connection portions 28, 29 to each other, and not only the first left and right bosses 28*a*, 28*b* constituting the first connection portion 28 and the second left and right bosses 29*a*, 29*b* constituting the second connection portion 29 but also the left and right projecting wall portions 30*a*, 30*b* constituting the connection wall 30 are mutually joined by welding; this makes it possible to eliminate a blind spot into which a welding torch cannot make an entry to thereby improve the welding reliability and workability.

Moreover, in the left and right arm top pieces P1, P2, the joining portions that join the left and right projecting wall portions 30*a*, 30*b* to the first left and right bosses 28*a*, 28*b*, the joining portions that join the left and right projecting wall portions 30*a*, 30*b* to the second left and right bosses 29*a*, 29*b*, the joining portions that join the left and right projecting wall portions 30*a*, 30*b* to the left and right side walls 26, 27, and the joining portions that join the first left and right bosses 28*a*, 28*h* and the second left and right bosses 29*a*, 29*b* to the left and right side walls 26, 27 are given respective gently curved surfaces CS1, CS2, CS3, CS4 to prevent each of the joining portions from have an acute angle; this allows a load to be smooth transmitted through the joining portions to prevent occurrence of stress concentration, thereby enabling the arm top 25 to have further enhanced strength. Besides, the gently curved surface of each joining portion facilitates the welding to thereby improve the welding reliability and workability.

In addition, forming the recess 28*c* along the forward half periphery of the distal end of each of the left and right top pieces P1, P2 and the left and welding right arm top pieces P1, P2 together at the recesses 28*c* allow the forward half peripheries of the joint portions (weld line Lw) on the distal end side of the arm top pieces P1, P2 that are most likely to come into contact with the ground and/or rocks during a work such as excavation to lie at a position radially inner than the other part to be protected from exposure to the outside. This is extremely effective for suppressing wear in the joint portions due to contact with the ground.

Figure 8:
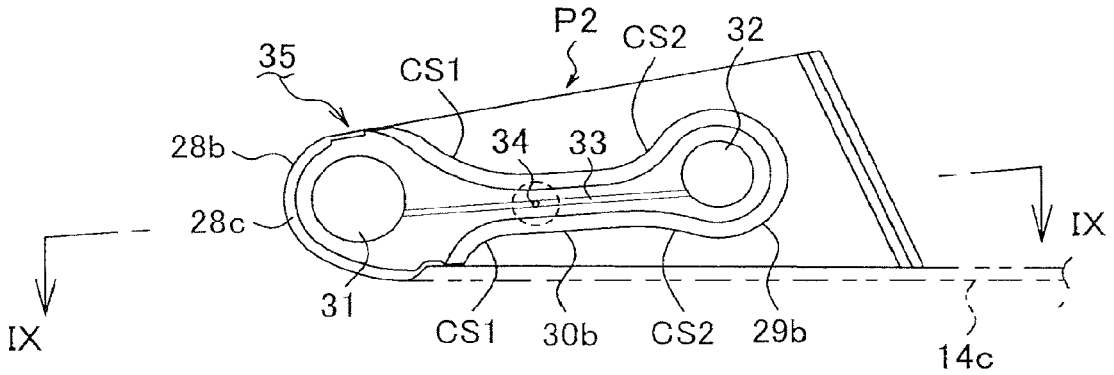
FIG. 8 is a sectional view of an arm top according to a second embodiment of the present invention, showing the section corresponding to that shown in FIG. 7.
Figure 9:
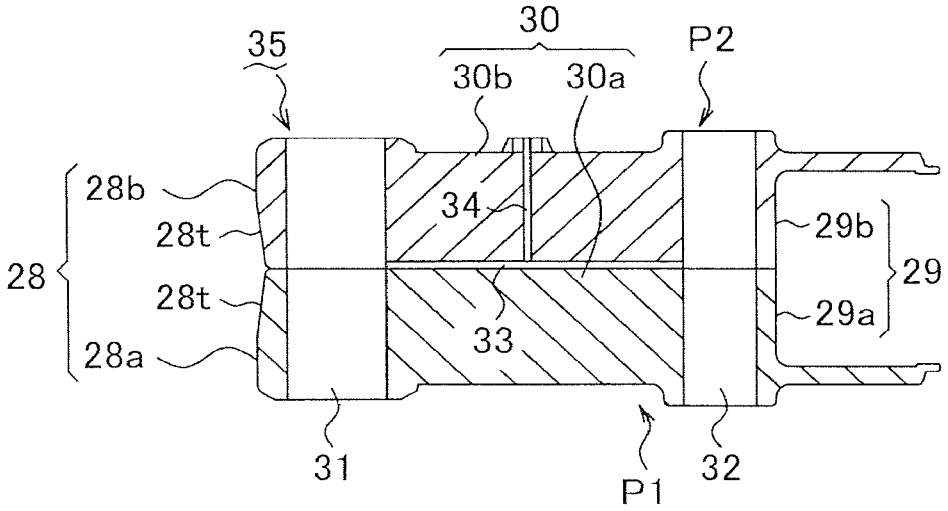
FIG. 9 is a sectional view taken along the line IX-IX in FIG. 8.

FIGS. 8 and 9 show an arm top 35 of the arm according to the second embodiment of the present invention. The arm top 35 differs from the arm top 25 of the first embodiment only in the following aspects.

The arm top 35 according to the second embodiment is provided with an oil supply passage 33 formed in an inner side of a right arm top piece P2. The oil supply passage 33 is constituted by a groove extending from a first pin hole 31 enclosed by a right boss 28*b* to a second pin hole 32 enclosed by a right boss 29*b* via a right projecting wall portion 30*b*. In the state that left and right arm top pieces P1, P2 are joined together to integrally form the arm top 35, the groove and the left arm top piece P1 covering the groove defines the oil supply passage 33 in the form of a tunnel.

The thus formed oil supply passage 33 can be shared by first and second connection portions 28, 29. The sharing makes it possible to simplify the oil supply structure and reduce the number of components required for the oil supply structure, and also to improve the efficiency of oil supply work.

The arm top 35 according to the second embodiment includes an oil supply hole 34 allowing lubricant oil to be supplied into the oil supply passage 33 through the oil supply hole 34 from the outside. The oil supply hole 34 passes through the right projecting wall portion 30*b* of the right arm top piece P2 in the left-right direction, having an outer end opened to the outside and an inner end in communication with the oil supply passage 33. The combination of the oil supply hole 34 and the oil supply passage 33 allows lubricant oil to be supplied to the first and second connection portions 28, 29 almost simultaneously and evenly.

It is also possible to form the oil supply passage 33 in the left arm top piece P1. Alternatively, the left and right arm top pieces P1, P2 may be formed with respective grooves, which combine to form an oil supply passage having a circular section.

Furthermore, the left and right arm top pieces P1, P2 according to the second embodiment includes respective tapered portions 28*t* in place of the recess 28*c*. The tapered portions 28*t*, which serve as means for locating forward half peripheries of respective joint portions of the left and right arm top pieces P1, P2 on the distal end side that are joined together at a position radially inner than the other part having a maximum diameter (the parts on laterally both sides of the joint portions), are formed in respective forward half periphery of outer surfaces of the first left and right bosses 28*a*, 28*b* constituting the first connection portion 28 on the distal end side of the left and right arm top pieces P1, P2 as shown in FIG. 9, each including a portion tapered in such a direction that the boss diameter gradually decreases toward the joint portions lying in the middle (the boundary between the left and right arm top pieces P1, P2). The tapered portions 28*t* enable the same advantageous effect as that by the recess 28*c*, i.e., the effect of preventing the weld from wearing due to contact with the ground or the like to be obtained.

Figure 10:
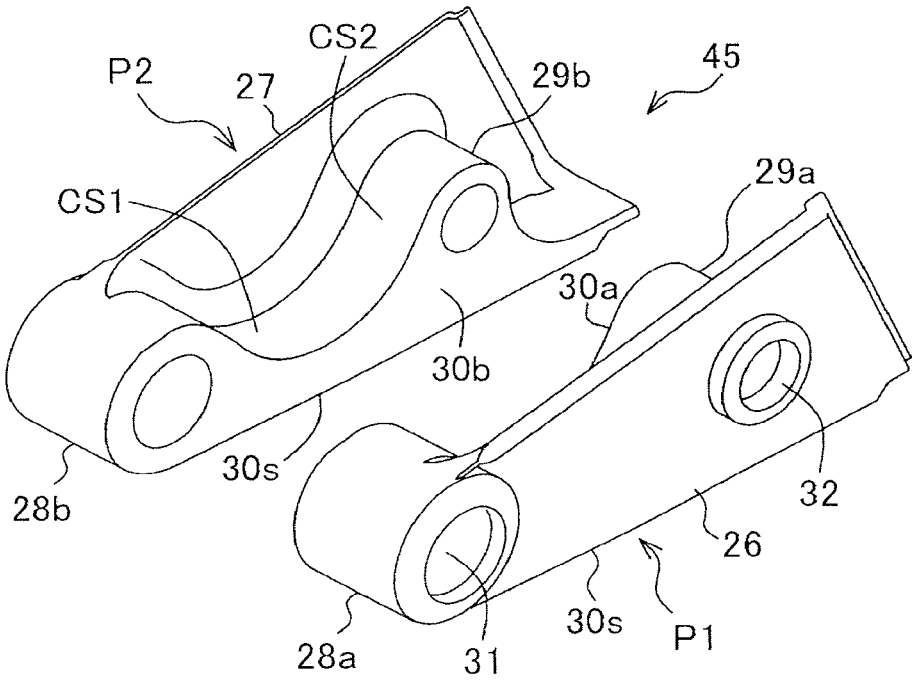
FIG. 10 is a perspective view of an arm top according to a third embodiment of the present invention shown at the same angle as the arm top in FIG. 1.
Figure 11:
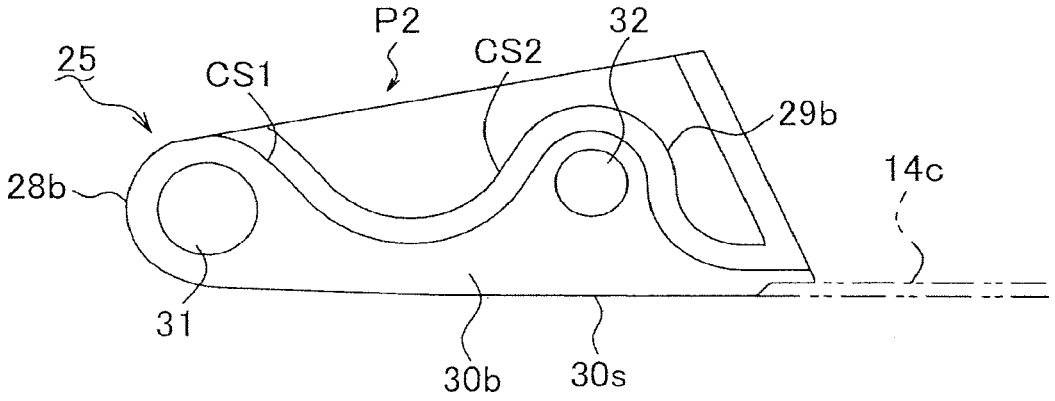
FIG. 11 is a sectional view of the arm top according to the third embodiment of the present invention, showing the section corresponding to that shown in FIG. 7.

FIGS. 10 and 11 show an arm top 45 of the arm according to the third embodiment of the present invention. The arm top 45 further has a function of restraining the bottom surface of the distal end of the arm from abrasive wear.

Figure 13:
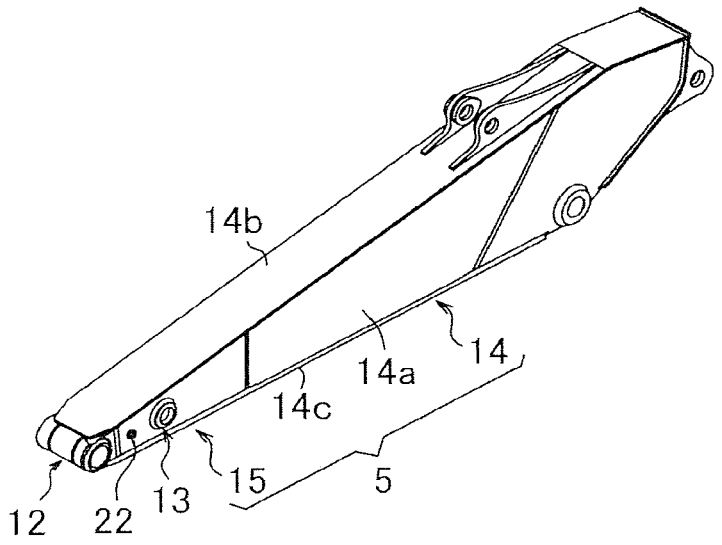
FIG. 13 is a perspective view of the arm according to the reference example.
Figure 14:
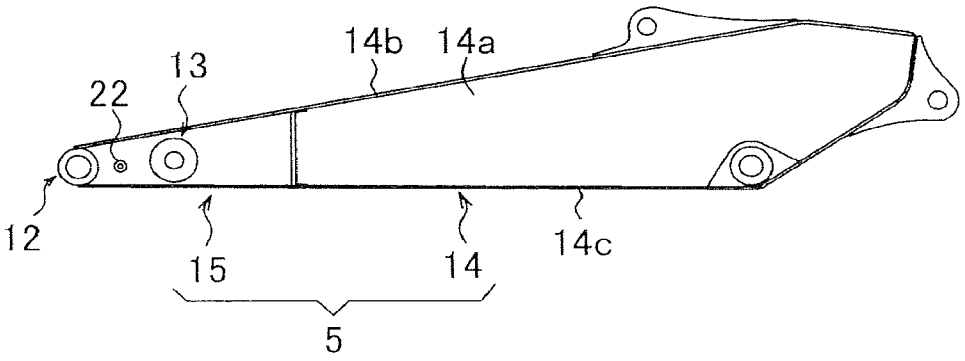
FIG. 14 is a side view of the arm according to the reference example.

In the arm according to the reference example, as shown in FIGS. 13 and 14, the top plate 14*b* and the bottom plate 14*c* constituting the arm body 14 extend over the full length of the arm and respective distal ends of the top plate 14*b* and the bottom plate 14*c* are welded over a top surface and a bottom surface of the arm top 15, respectively; therefore, the distal end of the bottom plate 14*c* forms the bottom of the distal end of the arm, i.e., a part most likely to come into contact with the ground or the like during a work such as excavation. The distal end of the bottom plate 14*c* is therefore brought into significant wear and damage.

In the arm top 45 according to the third embodiment, each of left and right projecting wall portions 30*a*, 30*b* constituting a connection wall 30 includes a bottom surface 30*s* capable of solving the above-mentioned problem. Each bottom surface 30*s* is in the form of a flat surface substantially flush with a bottom surface of the bottom plate 14*c* of the arm body 14. These bottom surfaces 30*s*, which constitute a bottom surface of the arm top 45, namely, a bottom surface defining the bottom of the distal end of the arm, and are in the form of flat surfaces substantially flush with the bottom surface of the bottom plate 14*c* of the arm body 14, can be effectively restrained from being worn and damaged.

In this case, preferred is that the distal end of the bottom plate 14*c* of the arm body 14 are welded, as shown in FIG. 11, to respective parts of the bottom surfaces 30*s* of the left and right projecting wall portions 30*a*, 30*b*, the parts being rearward of the second connection portion 29, for example, between the first left and right bosses 28*a*, 28*b* and the second left and right bosses 29*a*, 29*b*, so as to avoid the second left and right bosses 29*a*, 29*b* constituting the second connection portion 29 on which a great load acts.

The present invention is not limited to those arms described above that constitute a working attachment for an excavator. The present invention can be similarly applied to those arms provided for construction machines other than excavators such as dismounting machines and crushing machines, the arms having a distal end for allowing a working tool other than a bucket, such as a breaker or a grinder, to be attached thereto.

As described above, there is provided an arm to constitute a working attachment for a construction machine, the arm being formed by casting and capable of being easily produced with high accuracy. The arm includes: an arm body to be attached to a distal end of a boom constituting the working attachment; and an arm top attached to a distal end of the arm body. The arm top includes: a pair of left and right side walls; a first connection portion disposed at a distal end of the arm top to span the pair of side walls so as to define a first pin hole for allowing a pin for connecting a working tool to the distal end of the arm top to be inserted into the first pin hole; a second connection portion disposed at a position closer to a proximal end of the arm top than the first connection portion to span the pair of side walls so as to define a second pin hole for allowing a pin for connecting a link for actuating the working tool to be inserted in the second pin hole; and connection walls formed on respective inner surfaces of the side walls, the connection walls having respective shapes to connect the pair of side walls to each other and connect the first and second connection portions to each other. The arm top includes a left arm top piece and a right arm top piece that are individually formed by casting, the left arm top piece having a first left boss constituting the first connection portion, a second left boss constituting the second connection portion, and a left projecting wall portion constituting the connection wall, the right top piece having a first right boss constituting the first connection portion, a second right boss constituting the second connection portion, and a right projecting wall portion constituting the connection wall. The first left boss and the first right boss have respective surfaces opposed to each other in a left-right direction of the arm top, the second left boss and the second right boss have respective surfaces opposed to each other in the left-right direction of the arm top, and the left projecting wall portion and the right projecting wall portion have respective surfaces opposed to each other in the left-right direction. The left and right arm top pieces are joined together by welding at the opposed surfaces of the first left boss and the first right boss, at the opposed surfaces of the second left boss and the second right boss, and at the opposed surfaces of the left projecting wall portion and the right projecting wall portion, thereby being integrated to form the arm top.

In the above-described arm, the arm top is originally divided into the separate left and right arm top pieces that are individually formed by casting and joined to each other to be integrated to thereby form the arm top, in other words, the piece obtained by casting for forming the arm top are divided into the left and right arm top pieces, allowing a mold for the casting and the casted products to have a small and simple shape. This makes it possible to easily produce the arm top with an improved dimensional accuracy, as compared to an arm top entirely formed of a single casted product.

In addition, the left and right arm top pieces, which arc welded not at the joints between the first and second connection portions and the left and right side walls where stress concentration is likely to occur but at the widthwise middle of the arm top with low stress, can have a high strength.

If the left and right arm top pieces are integrated by welding only at the opposed surfaces of the first left and right bosses and the oppose surfaces of the second left and right bosses, many parts would be out of reach of a welding tool such as a welding torch, which would reduce the welding reliability and workability. In contrast, providing the left and right arm top pieces with respective left and right projecting wall portions having respective shapes connecting the left and right side wall portions to each other and the first and second connection portions to each other and integrating the left and right arm top not only by welding of the first left and right bosses and the second left and right bosses but also by welding of the left and right wall portions make it possible to improve the welding reliability and workability.

It is preferred that the left and right arm top pieces include respective joining portions that join the left projecting wall portion to each of the first and second left bosses, a joining portion that joins the left projecting wall portion to the left side wall, respective joining portions that join the first and second left bosses to the left side wall, respective joining portions that join the right projecting wall portion to the first and second right bosses, a joining portion that joins the right projecting wall portion to the right side wall, and respective joining portions that join the first and second right bosses to the right side wall, each of the joining portions having a curved surface. This makes it possible to suppress stress concentration by allowing a load to be smooth transmitted through the joining portion to thereby further improve the strength of the arm top, differently from the case where each joining portion forms an acute angle. Besides, providing each joining portion with the curved surface facilitates the welding, thereby allowing the welding reliability and workability to be improved.

It is preferred that at least one of the left and right arm top pieces is provided with an oil supply passage extending from the first pin hole defined by the first connection portion to the second pin hole defined by the second connection portion through the connection wall. The oil supply passage can be shared by the first and second connection portions, and the sharing makes it possible to simplify the oil supply structure and reduce the number of components required for the oil supply structure, and also to improve the efficiency of oil supply work.

In this case, it is preferred that at least one of the left and right arm top pieces is provided with an oil supply hole for supplying lubricant oil into the oil supply passage from the outside of the arm top piece, the oil supply hole passing through at least one of the left and right projecting wall portions and having an outer end opened to the outside and an inner end in communication with the oil supply passage. The oil supply hole allows the lubricant oil to be supplied to the first and second connection portions almost simultaneously and evenly.

It is preferred that the left and right first bosses constituting the first connection portion includes respective joint portions joined to each other by welding, at least a forward half periphery of each of the joint portions on the distal end side of the arm top pieces lying at a position radially inner than a forward periphery of an outer surface of the first connection portion that has a maximum diameter. Thus locating the forward half peripheries of the joint portions of the first left and right bosses on the distal end side of the left and right arm top pieces, i.e., the parts that are most likely to come into contact with the ground and/or rocks during a work such as excavation, at a position radially inner than the part having a maximum diameter makes it possible to effectively protect the forward half peripheries of the joint portions from wear due to contact with the ground and/or rocks.

Specifically, it is possible either that at least the forward half periphery of the joint portion of each of the first left and right bosses on the distal end side of the arm top pieces is recessed radially inward so as to have a smaller diameter than that of the other part or that at least a forward half periphery of each of the first left and right bosses on the distal end side of the arm top pieces is tapered in such a way that the diameter of the forward half periphery decreases toward the joint portions in a width direction of the arm top.

The arm body, for example, appropriately includes left and right side plates, a top plate, and a bottom plate that form a box structure. In this case, it is preferred that the connection wall has a flat bottom surface substantially flush with a bottom surface of the bottom plate of the arm body. The bottom surface can be restrained from being worn and damaged, though being the bottom of the distal end of the arm that is most likely to come into contact with the ground or the like during a work such as excavation.

The present invention also provides a method for producing an arm to constitute a working attachment for a construction machine, the arm including an arm body to be attached to a distal end of a boom constituting the working attachment, and an arm top serving as an arm distal-end member to be attached to a distal end of the arm body, the arm top including: a pair of left and right side walls; a first connection portion disposed at a distal end of the arm top and spanning the side walls so as to define a first pin hole for allowing a pin for connecting a working tool to the distal end of the arm top to be inserted into the first pin hole; a second connection portion disposed at a position between the first connection portion and a proximal end of the arm top and spanning the side walls so as to define a second pin hole for allowing a pin for connecting a link for actuating the working tool to be inserted into the second pin hole; and a connection wall formed on respective inner surfaces of the side walls and having a shape connecting the side walls to each other and connecting the first and second connection portions to each other. The method includes: individually forming a left arm top piece and a right arm top piece by casting, the left arm top piece having a first left boss constituting the first connection portion, a second left boss constituting the second connection portion, and a left projecting wall portion constituting the connection wall, and the right top piece having a first right boss constituting the first connection portion, a second right boss constituting the second connection portion, and a right projecting wall portion constituting the connection wall, the first left boss and the first right boss having respective surfaces opposed to each other in a left-right direction of the arm top, the second left boss and the second right boss having respective surfaces opposed to each other in the left-right direction of the arm top, and the left projecting wall portion and the right projecting wall portion having respective surfaces opposed to each other in the left-right direction; joining the left arm top piece and the right arm top piece by welding at the opposed surfaces of the first left boss and the first right boss, at the opposed surfaces of the second left boss and the second right boss, and at the opposed surfaces of the left projecting wall portion and the right projecting wall portion, thereby integrating the left arm top piece and the right arm top piece to form the arm top; and attaching the arm top to the distal end of the arm body.

The invention claimed is:

1. An arm to constitute a working attachment for a construction machine, comprising:

an arm body to be attached to a distal end of a boom constituting the working attachment; and an arm top attached to a distal end of the arm body, wherein:

the arm top includes: a pair of left and right side walls; a first connection portion disposed at a distal end of the arm top to span the pair of side walls so as to define a first pin hole for allowing a pin for connecting a working tool to the distal end of the arm top to be inserted into the first pin hole; a second connection portion disposed at a position closer to a proximal end of the arm top than the first connection portion to span the pair of side walls so as to define a second pin hole for allowing a pin for connecting a link for actuating the working tool to be inserted in the second pin hole; and connection walls formed on respective inner surfaces of the side walls, the connection walls having respective shapes to connect the pair of side walls to each other and connect the first and second connection portions to each other;

the arm top includes a left arm top piece and a right arm top piece that are individually formed by casting, the left arm top piece having a first left boss constituting the first connection portion, a second left boss constituting the second connection portion, and a left projecting wall portion constituting the connection wall, the right top piece having a first right boss constituting the first connection portion, a second right boss constituting the second connection portion, and a right projecting wall portion constituting the connection wall, the first left boss and the first right boss having respective surfaces opposed to each other in a left-right direction of the arm top, the second left boss and the second right boss having respective surfaces opposed to each other in the left-right direction of the arm top, and the left projecting wall portion and the right projecting wall portion having respective surfaces opposed to each other in the left-right direction; and the left and right arm top pieces are joined together by welding at the opposed surfaces of the first left boss and the first right boss, at the opposed surfaces of the second left boss and the second right boss, and at the opposed surfaces of the left projecting wall portion and the right projecting wall portion, thereby being integrated to form the arm top.

2. The arm for construction machine according to claim 1, wherein the left and right arm top pieces include respective joining portions that join the left projecting wall portion to each of the first and second left bosses, a joining portion that joins the left projecting wall portion to the left side wall, respective joining portions that join the first and second left bosses to the left side wall, respective joining portions that join the right projecting wall portion to the first and second right bosses, a joining portion that joins the right projecting wall portion to the right side wall, and respective joining portions that join the first and second right bosses to the right side wall, each of the joining portions having a curved surface.

3. The arm for a construction machine according to claim 1, wherein at least one of the left and right arm top pieces is provided with an oil supply passage extending from the first pin hole defined by the first connection portion to the second pin hole defined by the second connection portion through the connection wall.

4. The arm for a construction machine according to claim 3, wherein at least one of the left and right arm top pieces is provided with an oil supply hole for supplying lubricant oil into the oil supply passage from the outside of the arm top piece, the oil supply hole passing through at least one of the left and right projecting wall portions and having an outer end opened to the outside and an inner end in communication with the oil supply passage.

5. The arm for a construction machine according to claim 1, wherein the left and right first bosses constituting the first connection portion includes respective joint portions joined to each other by welding, at least a forward half periphery of each of the joint portions on the distal end side of the arm top pieces lying at a position radially inner than a forward periphery of an outer surface of the first connection portion that has a maximum diameter.

6. The arm for a construction machine according to claim 5, wherein at least a forward half periphery of the joint portion of each of the first left and right bosses on the distal end side of the arm top pieces is recessed radially inward so as to have a smaller diameter than that of the other part.

7. The arm for a construction machine according to claim 5, wherein at least the forward half periphery of each of the first left and right bosses on the distal end side of the arm top pieces is tapered in such a way that the diameter of the forward half periphery decreases toward the joint portions in a width direction of the arm top.

8. The arm for a construction machine according to claim 1, wherein the arm body includes left and right side plates, a top plate, and a bottom plate that form a box structure, the connection wall having a flat bottom surface substantially flush with a bottom surface of the bottom plate of the arm body.

9. A method for producing an arm to constitute a working attachment for a construction machine, the arm including an arm body to be attached to a distal end of a boom constituting the working attachment, and an arm top serving as an arm distal-end member to be attached to a distal end of the arm body, the arm top including: a pair of left and right side walls; a first connection portion disposed at a distal end of the arm top and spanning the side walls so as to define a first pin hole for allowing a pin for connecting a working tool to the distal end of the arm top to be inserted into the first pin hole; a second connection portion disposed at a position between the first connection portion and a proximal end of the arm top and spanning the side walls so as to define a second pin hole for allowing a pin for connecting a link for actuating the working tool to be inserted into the second pin hole; and a connection wall formed on respective inner surfaces of the side walls and having a shape connecting the side walls to each other and connecting the first and second connection portions to each other, the method comprising:

individually forming a left arm top piece and a right arm top piece by casting, the left arm top piece having a first left boss constituting the first connection portion, a second left boss constituting the second connection portion, and a left projecting wall portion constituting the connection wall, and the right top piece having a first right boss constituting the first connection portion, a second right boss constituting the second connection portion, and a right projecting wall portion constituting the connection wall, the first left boss and the first right boss having respective surfaces opposed to each other in a left-right direction of the arm top, the second left boss and the second right boss having respective surfaces opposed to each other in the left-right direction of the arm top, and the left projecting wall portion and the right projecting wall portion having respective surfaces opposed to each other in the left-right direction;

joining the left arm top piece and the right arm top piece by welding at the opposed surfaces of the first left boss and the first right boss, at the opposed surfaces of the second left boss and the second right boss, and at the opposed surfaces of the left projecting wall portion and the right projecting wall portion, thereby integrating the left arm top piece and the right arm top piece to form the arm top; and attaching the arm top to the distal end of the arm body.

* * * * *